US006918398B2

(12) United States Patent
Edelmann et al.

(10) Patent No.: US 6,918,398 B2
(45) Date of Patent: Jul. 19, 2005

(54) SYSTEMS AND METHODS FOR CONTROLLING WAREWASHER WASH CYCLE DURATION, DETECTING WATER LEVELS AND PRIMING WAREWASHER CHEMICAL FEED LINES

(75) Inventors: David Charles Edelmann, Troy, OH (US); Richard W. Cartwright, Piqua, OH (US); Gary V. Hoying, Colleyville, TX (US)

(73) Assignee: Premark FEG L.L.C., Wilmington, DE (US)

( * ) Notice: Subject to any disclaimer, the term of this patent is extended or adjusted under 35 U.S.C. 154(b) by 39 days.

(21) Appl. No.: 10/889,687

(22) Filed: Jul. 13, 2004

(65) Prior Publication Data

US 2004/0244819 A1 Dec. 9, 2004

Related U.S. Application Data

(62) Division of application No. 10/287,202, filed on Nov. 4, 2002, now abandoned.

(51) Int. Cl.[7] ..... B08B 3/00

(52) U.S. Cl. ..... 134/57 D; 134/56 D; 134/95.1; 134/107

(58) Field of Search ..... 134/25.2, 56 D, 134/57 D, 58 D, 95.1, 98.1, 107, 113, 186, 200

(56) References Cited

U.S. PATENT DOCUMENTS

| | | | |
|---|---|---|---|
| 3,939,360 | A | 2/1976 | Jackson |
| 4,142,539 | A | 3/1979 | Shih et al. |
| 4,242,051 | A | 12/1980 | Mason et al. |
| 4,373,863 | A | 2/1983 | Mason et al. |
| 4,382,382 | A | 5/1983 | Wang |
| 4,509,543 | A | 4/1985 | Livingston et al. |
| 4,562,605 | A | 1/1986 | Quintarelli |
| 4,628,302 | A | 12/1986 | Barr et al. |
| 4,756,321 | A | 7/1988 | Livingston et al. |
| 4,810,306 | A | 3/1989 | Noren |
| 4,872,466 | A | 10/1989 | Noren |
| 5,017,909 | A | 5/1991 | Goekler |
| 5,027,075 | A | 6/1991 | Harding, Jr. |
| 5,038,807 | A | 8/1991 | Bailey et al. |
| 5,050,433 | A | 9/1991 | Lumetta |
| 5,137,041 | A | 8/1992 | Hall |
| RE34,073 | E | 9/1992 | Suzuki |
| 5,150,062 | A | 9/1992 | Takeuchi |
| 5,176,297 | A | 1/1993 | Mooney et al. |
| 5,202,582 | A | 4/1993 | Szynal et al. |
| 5,218,988 | A | 6/1993 | McNamara et al. |
| 5,220,514 | A | 6/1993 | John |

(Continued)

FOREIGN PATENT DOCUMENTS

| | | |
|---|---|---|
| WO | WO 90/14789 | 12/1990 |

OTHER PUBLICATIONS

Specifications—(3 Pages) LX Series Dishmachine dated (Apr. 2001).

Service Manual for LX Dishwashers (F24521)(Rev. A, Jun. 2001)(72 Pages).

*Primary Examiner*—Frankie L. Stinson
*Assistant Examiner*—Joseph L. Perrin
(74) *Attorney, Agent, or Firm*—Thompson Hine LLP

(57) ABSTRACT

A system and method of selectively extending a wash cycle duration of a warewasher beyond a set minimum duration provides suitable cleaning of wares while at the same time seeking to increase the number of wash cycles per unit time. A system and method for detecting water level in a wash chamber or other tank provides the ability to identify a progressively fouling electrode. A system and method of automatically priming one or more chemical feed lines of a warewasher is also described.

4 Claims, 5 Drawing Sheets

U.S. PATENT DOCUMENTS 5,226,313 A 7/1993 Murata et al.
5,309,939 A 5/1994 Stickel et al.
5,378,993 A 1/1995 Flask et al.
5,438,323 A 8/1995 Shea
5,453,131 A 9/1995 Chan et al.
5,462,606 A 10/1995 Burns
5,493,922 A 2/1996 Ramey et al.
5,494,061 A 2/1996 Chan et al.
5,500,050 A 3/1996 Chan et al.
5,543,717 A 8/1996 Kordas
5,555,583 A 9/1996 Berkcan
5,560,060 A 10/1996 Dausch et al.
5,603,233 A 2/1997 Erickson et al.
5,611,867 A 3/1997 Cooper et al.
5,641,006 A 6/1997 Autrey et al.
5,647,391 A 7/1997 Chan et al.
5,792,276 A 8/1998 Driessen
5,806,541 A 9/1998 Cooper et al.
5,820,691 A * 10/1998 Hartman ..... 134/18
5,839,454 A 11/1998 Matz
6,035,472 A 3/2000 Barbe
6,055,831 A 5/2000 Barbe
6,092,541 A 7/2000 Crane et al.
6,223,129 B1 4/2001 Chan et al.
6,338,760 B1 * 1/2002 Landaeus et al. ..... 134/18

* cited by examiner

SYSTEMS AND METHODS FOR CONTROLLING WAREWASHER WASH CYCLE DURATION, DETECTING WATER LEVELS AND PRIMING WAREWASHER CHEMICAL FEED LINES

This is a division of application Ser. No. 10/287,202, filed Nov. 4, 2002, now abandoned.

TECHNICAL FIELD

This application relates generally to warewashers, and more particularly to (i) a system and method for automatically controlling wash cycle duration of a warewasher system, (ii) a system and method for detecting water level in a warewasher or other system and (iii) a system and method for sensing and delivering cleaning agents and sanitizers into a warewasher.

BACKGROUND

Warewashers may be used for cleaning and sanitizing pots, pans, plates, glasses, eating utensils, and other wares. The term warewasher is used synonymously with the term dishwasher herein. Typically, the incoming water to a warewasher is supplied at a temperature of 140° F., the standard temperature achieved by conventional hot water heaters. However, in other cases the incoming water temperature may be as low as 110° F. Warewashers typically have a water booster heater to raise the water temperature to a desired temperature, typically around 180° F. Batch-type warewashers are units that clean wares on a batch basis, that is, one load at a time. Between cleaning operations, clean wares from one load are removed from a wash chamber and dirty wares of the next load are placed into the wash chamber.

Currently, warewashers are provided with two fixed temperature rise options, either a 40° F. rise or a 70° F. rise. The desired temperature rise option is programmed at the factory or by a service technician based upon an anticipated incoming water temperature and results in a wash cycle of a set duration, where the set duration for 40° F. rise is shorter than the set duration for 70° F. rise. In most commercial applications it is desirable to maximize the number of wash loads or batches that a warewasher can handle in any given time period, with the entire cleaning cycle often being completed in a matter of a few minutes as compared to thirty minutes or more for typical non-commercial dishwashers. Accordingly, it would be desirable to provide a new system and a method of controlling the duration of the wash cycle in attempt to achieve such a goal.

During various cycles of warewasher operation it is often necessary to detect the level of water within the wash chamber. Electrical probes have been used in the past for such purposes. However, over time lime deposits can form on such probes reducing the probe's ability to accurately detect the presence/absence of liquid in the wash chamber. One attempt to address the lime deposit problem is described in U.S. Pat. No. 6,223,129 where a linear regression technique is used. However, the system of U.S. Pat. No. 6,223,129 does not track the build up of lime deposits over time and does not provide the ability to detect the presence of a metal utensil shorting the electrodes of the probe. Accordingly, an improved water level detection system and method is desirable.

Chemicals such as detergents, sanitizers and rinse agents are often used in connection with warewasher systems. Such chemicals are typically fed into the wash chamber under control of respective pumps. When the supply of one of these chemicals runs out, the absence of the chemical from the wash and/or rinse operations can detrimentally affect cleaning and/or sanitation. Accordingly, chemical sensors have been used in the past along chemical feed lines leading from the chemical supply to the wash chamber. Exemplary of such a chemical sensor system is that described in U.S. Pat. No. 5,378,993. Warewashers have also been provided with a chemical out indicator (e.g., an LED, LCD or other light display) to advise a user if the chemical is not present in the line to prompt the user to check the line and or add more chemicals. After the new chemicals have been added, users have also been provided the ability to prime the chemical feed line by manually depressing a chemical prime button. However, users do not always prime the feed line properly. Accordingly, it would be desirable to provide an improved chemical feed line sensor system and method and associated arrangement to prime a chemical feed line.

SUMMARY

In one aspect, a method for selectively extending a warewasher wash cycle duration beyond a set minimum duration involves the steps of: beginning the wash cycle; heating rinse water during the wash cycle; running the wash cycle for the set minimum duration; and after the wash cycle has run for the set minimum duration: either ending the wash cycle if a determination is made the temperature of the rinse water has reached a desired rinse water temperature or continuing the wash cycle if a determination is made that the temperature of the rinse water has not reached the desired rinse water temperature.

In another aspect, a warewasher system includes a wash chamber for receiving objects to be washed and a pump for recirculating wash water through the wash chamber during a wash cycle. A tank and associated heater are provided for heating rinse water along with a path for delivering water from the tank to the wash chamber. A flow control device controls water flow along the path. A temperature sensor indicates a temperature of the rinse water in the tank. A controller is connected to receive input from the temperature sensor, connected to control the flow control device and the pump and has at least one operating mode that, if active, will carry out the following steps for a wash cycle: heat rinse water during the wash cycle; and after the wash cycle runs for a set minimum duration: end the wash cycle if the temperature of the rinse water has reached a desired rinse water temperature, or extend the wash cycle if the temperature of the rinse water has not reached the desired rinse water temperature.

In a further aspect, a method for monitoring a liquid level within a tank or chamber using a sensor system formed by a first electrode spaced apart from a second electrode within the tank or chamber, involves the steps of: delivering an electrical signal to the first electrode; sampling an electrical parameter at the first electrode a plurality of times during application of the signal; adding the plurality of samples to produce a sample sum; and analyzing the sample sum to determine whether a volume of liquid within the tank or chamber contacts both the first electrode and second electrode. In one embodiment, the electrical signal is a voltage pulse, the electrical parameter is a voltage and the sample sum is a sample voltage sum.

In yet another aspect, a warewasher includes a wash chamber and a sensor system formed by a first electrode spaced apart from a second electrode, both electrodes within the chamber. A controller is electrically connected with at least the first electrode and operates to: deliver an electrical signal to the first electrode; sample an electrical parameter at the first electrode a plurality of times during application of the electrical signal; add the plurality of samples to produce a sample sum; and analyze the sample sum to determine whether a volume of liquid within the tank or chamber contacts both the first electrode and second electrode.

In a further aspect, a warewasher includes a wash chamber and a sensor system formed by a first electrode spaced apart from a second electrode within the chamber. A controller is electrically connected with at least the first electrode and operates to carry out the following steps: deliver a voltage pulse to the first electrode; sample voltage at the first electrode a plurality of times during application of the voltage pulse; add the plurality of voltage samples to produce a sample voltage sum; and compare the sample voltage sum to a shorted threshold sum, and if the sample voltage sum is less than the shorted threshold sum the controller makes a determination that the first electrode and second electrode are shorted by a metallic article within the tank.

In a further aspect, a method is provided for controlling a chemical feed system in a warewasher having a chemical feed path, a sensor system for detecting the presence/absence of a chemical along the chemical feed path and a chemical feed pump for moving chemicals along the chemical feed path to a wash chamber of the warewasher. The method involves the step of: when an absence of the chemical is detected along the chemical feed path, operation of the chemical feed pump is initiated, without requiring user interaction, in attempt to automatically prime the chemical feed path.

In still another aspect, a warewasher chemical feed system includes a chemical feed line extending from a chemical source to a wash chamber of the warewasher and a sensor system for detecting the presence/absence of a chemical along the chemical feed line. A pump moves chemicals along the chemical feed line to the wash chamber. A controller is connected with the sensor system and for controlling the pump. When an absence of the chemical along the chemical feed path is detected by the controller, the controller initiates operation of the pump in attempt to prime the chemical feed line.

DETAILED DESCRIPTION

Figure 1:
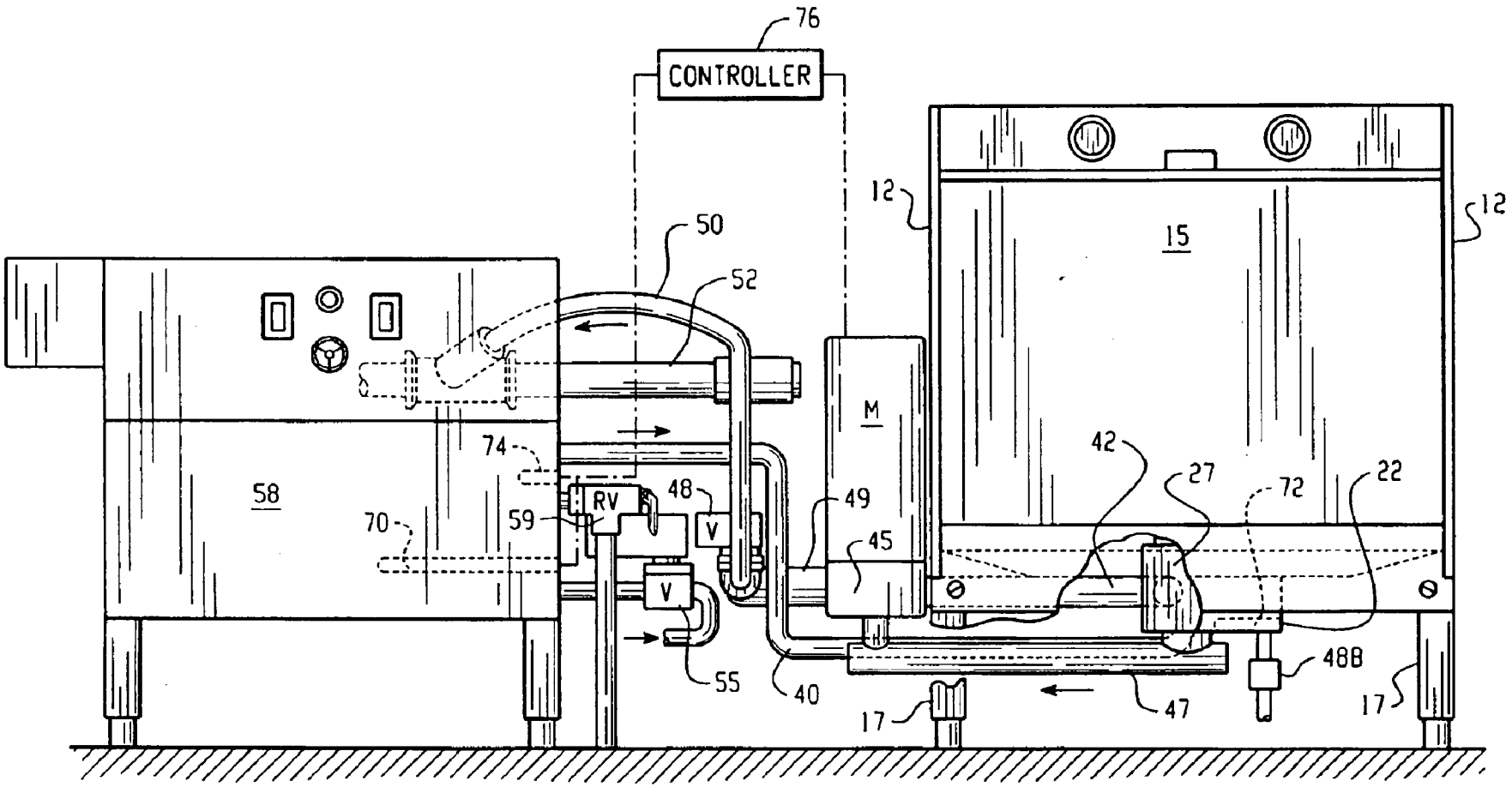
FIG. 1 is a front elevation of an exemplary warewasher system.
Figure 2:
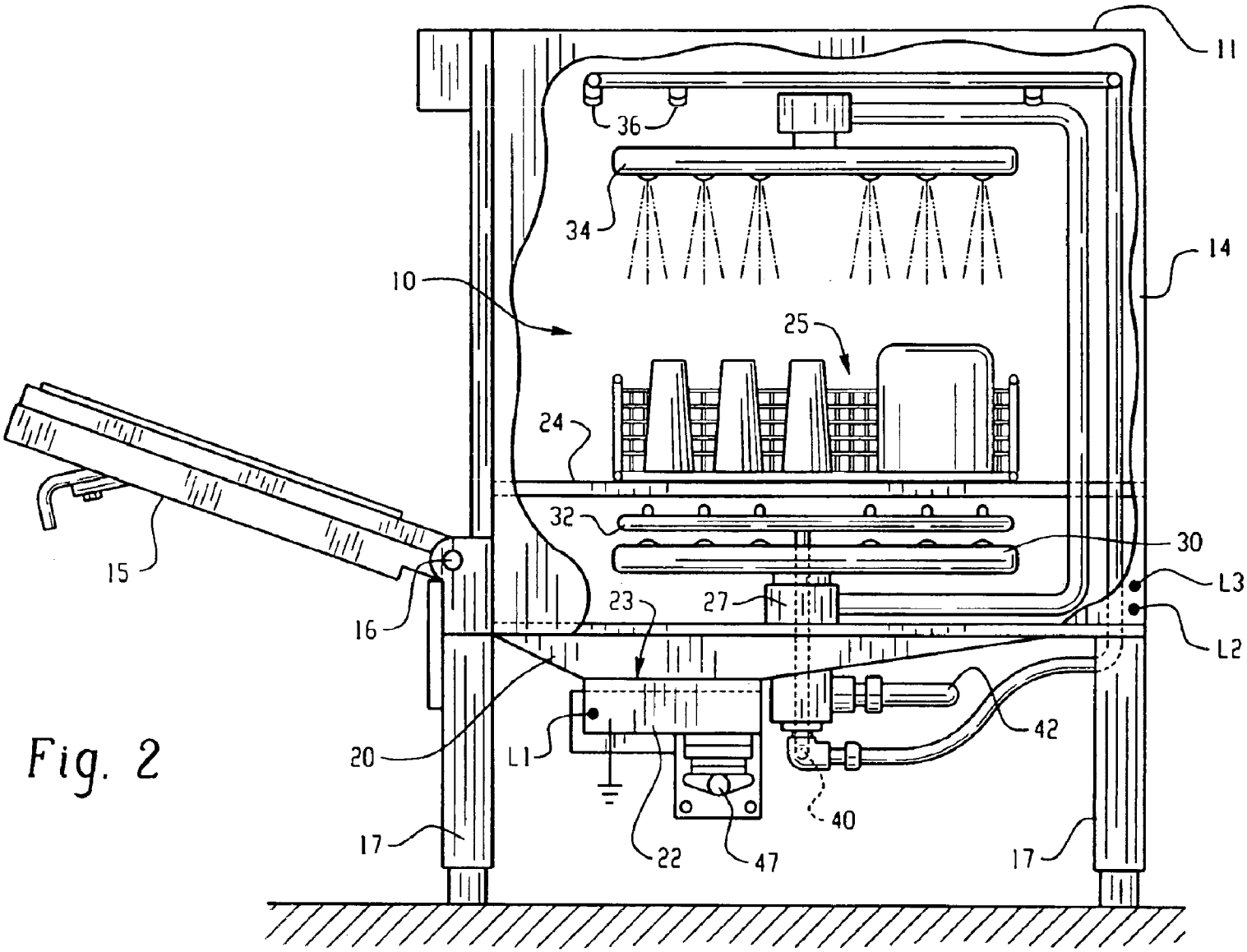
FIG. 2 is a side elevation of the warewasher of FIG. 1.

One embodiment of a warewasher and warewasher system suitable for incorporating various of the inventive features described herein is shown in FIGS. 1 and 2, the dishwashing machine includes a washing/rinsing chamber 10 that is defined by a cabinet, usually formed of stainless steel panels and components, and including a top wall 11, side walls 12 and rear wall 14, and a front facing door 15, hinged at its lower end, as indicated at 16. The chamber 10 is vented to ambient pressure through labyrinth seals (not shown) near the top wall. The cabinet is supported upon legs 17 which provide the clearance for the underside of the machine to permit cleaning beneath it as required by various local sanitation codes. At the bottom of the chamber, as part of the sloping bottom wall 20 of the cabinet, is a relatively small sump 22 that may have a removable strainer cover 23.

Above the bottom wall, rails 24 provide support for standard ware racks 25, loaded with ware to be washed and sanitized, which are loaded and unloaded through the front door. A coaxial fitting 27 is supported on the lower wall 20, centrally of the chamber, and this fitting in turn provides support for a lower wash arm 30 and lower rinse arm 32, each of conventional reaction type. An upper wash arm 34 and upper rinse spray heads 36 are supported from the top wall of the chamber.

The fresh hot rinse water supply line 40 extends from a source of hot water (to be discussed later) and is connected to the rinse arm 32 and rinse spray heads 36. The wash water supply line 42 is connected to the upper and lower wash arms 34 and 30, and receives wash water from a pump 45 mounted to one side of and exterior of the cabinet. The pump in turn is supplied from an outlet pipe 47 that extends from sump 22 and returns or recirculates the wash water sprayed over the ware in the rack during the wash segment of the machine cycle. Thus, during the wash portion of an operating cycle, pump 45 functions as a recirculating pump means.

A solenoid operated drain valve 48 is connected by a branch or drain pipe 49 to the wash water supply line 42 immediately downstream of the outlet of pump 45, and this valve when open allows flow of the pump discharge to a drain line 50 that may be connected into a suitable kitchen drain system 52, according to the applicable code regulations. In many kitchens in newer fast food restaurants the drain system may be considerably above the floor, thus the pumped discharge from the dishwasher is a desired feature in those installations. Also, when the drain valve is open, the path of least resistance to the pump output is through drain valve 48, and flow through the recirculating wash plumbing quickly diminishes due to back pressure created at the nozzles of the wash arms. At this time the pump 45 functions as a drain pump means. During the normal cycle of operations of this machine, drain valve 48 is opened once each cycle of operation, after the wash segment and before the rinse segment of the cycle.

A solenoid-operated fill valve 55 is connected, in the embodiment shown, to control the supply of fresh water to a booster heater tank 58, which is a displacement type heater tank having its inlet connected to receive water through fill valve 55, and its outlet connected to the fresh rinse water supply line 40. The booster heater has a heating element 70 and has the usual pressure relief valve 59 which will divert hot water through an overflow pipe in the event the tank pressure exceeds a predetermined value. While the illustrated booster heater tank 58 and pump 45 are shown alongside the main dishwasher housing, it is recognized that embodiments in which the pump 45 and booster are provided internal to the main housing, such as beneath the wash chamber, are within the contemplated scope of the various inventions described herein.

Also, a low capacity (e.g. 500 W) heater 72 may located in or on the sump 22. Such a heater may be, for example, a wire or similar heating strip embodied in an elastomeric pad that can be adhered to the exterior of the sump to heat water in the machine by conduction, if necessary. The heater 72 may alternatively be provided internally.

The foregoing fairly describes the warewasher set forth in U.S. Pat. No. 4,872,466. It is recognized that the various inventive features described below with reference to the above-described warewasher system could also be incorporated into other warewasher system constructions.

Control of Wash Cycle Duration

The booster tank 58 includes a temperature sensor 74 for indicating a temperature of the rinse water in the tank 58, and a controller 76 that receives input from the temperature sensor 74. The controller 76 is connected for controlling the various components of the warewasher system, including the valves, temperature sensor 74, heating elements 70 and 72 and pump 45. The controller 76 is typically provided internal to the exterior housing of the dishwasher. The controller 76 is operable to control various operations of the warewasher, including the duration of a wash cycle of the warewasher system.

Operation of the warewasher may be initiated by an operator turning the warewasher on via an interface knob, button etc. Once the warewasher is on, the steps of the washing operation may be performed automatically without any further intervention by the operator. In one step of the washing operation, which may be a first step, the wash chamber 12 may fill with water passed through the tank 58 to a first level L1 by opening valve 55 to cause tank overflow along path 40 into the warewasher. The tank heater 70 and the sump heater 72 may be turned on. The water in the tank 58 may then be heated to a preselected temperature, such as 192° F., or for approximately eight minutes, whichever occurs first. After the water in the tank 58 is heated as indicated by the temperature sensor 74 the wash chamber 10 may be filled to a third level L3, also through the tank 58. After the wash chamber 12 is filled to the third level L3, a wash cycle may be automatically initiated which may include a brief fill of the wash chamber 10 with rinse water for approximately three seconds. The water levels L1, L2 and L3 may be detected using one or more suitable water level sensors, an exemplary form of which is described in more detail below. During the wash cycle the wares in the wash chamber may be sprayed using a recirculated mixture of water and detergent, the supply of which will be described below, to clean the wares.

The duration of the wash cycle may be controlled by the controller 76 in accordance with an active program module stored in memory associated with a processor of the controller. After the wash cycle has concluded the wares may be rinsed using heated rinse water from the tank 58. In another step, at least part of the water in the wash chamber 10 is permitted to drain out through the drain after the wash cycle is completed, (e.g., for a certain time period or to a level indicated by the sensor at water level L2).

Figure 3:
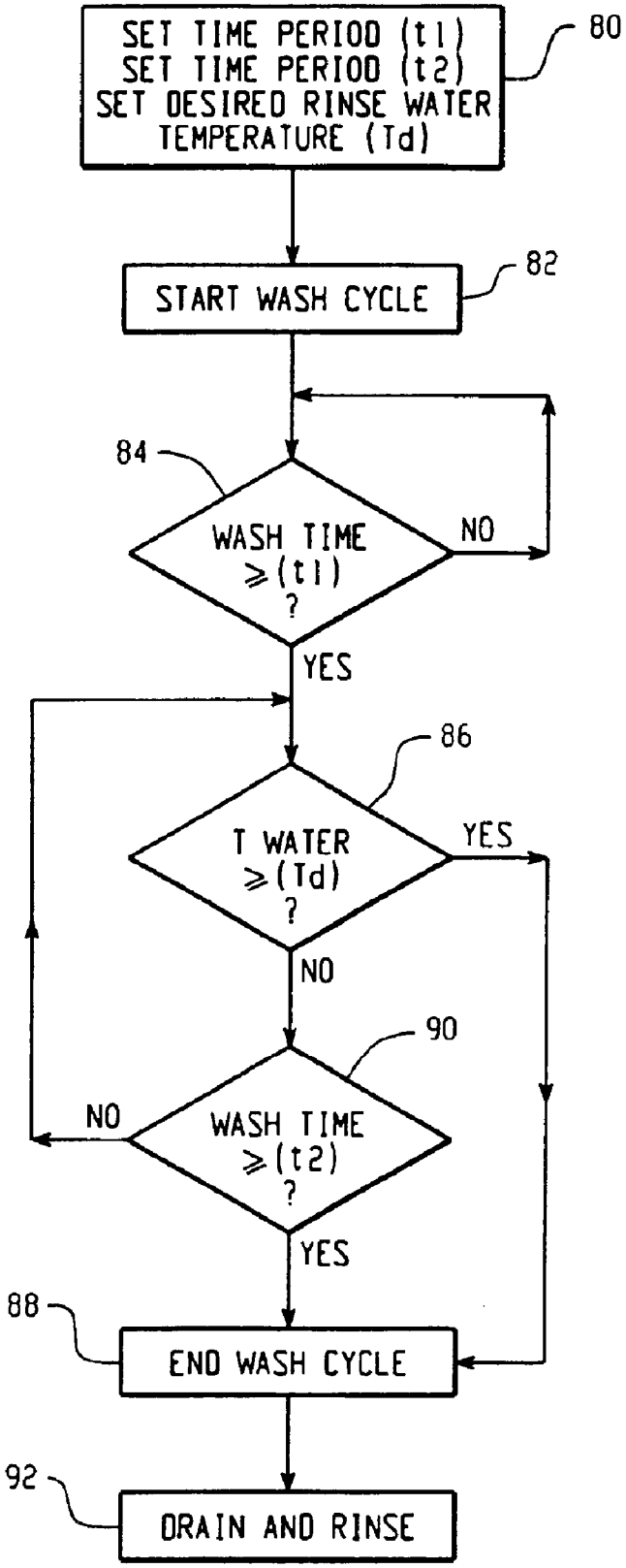
FIG. 3 is a flow chart depicting a method of controlling a wash cycle duration.

The controller 76 may be configured to selectively extend a warewasher wash cycle duration beyond a standard or set minimum duration as follows. Referring to the flow chart of FIG. 3, the standard minimum duration may be set in memory as time period t1 and a desired rinse water temperature Td may be set in memory as indicated at step 80. As the wash cycle begins in step 82, the rinse water in the booster tank 58 is also heated. The duration of the initiated wash cycle is tracked at step 84 to determine when the minimum duration is met. After the wash cycle runs for the standard minimum duration, the wash cycle is ended (step 88) if a determination is made that the temperature of the rinse water has reached the desired rinse water temperature as indicated by the YES path out of decision step 86. Thus, the wash cycle duration is extended only if a determination is made that the temperature of the rinse water in the tank 58 is below the desired rinse water temperature. In the illustrated embodiment, the wash cycle is extended until the rinse water temperature reaches the desired rinse water temperature per the loop back to step 86 or until a maximum duration is reached per step 90, which duration may be set in memory as time period t2 as indicated in prior step 80 and where time period t2 is, of course, longer than time period t1. After the wash cycle runs for the standard maximum duration t2, the wash cycle is ended even if the temperature of the rinse water is less than the desired rinse water temperature. Thus, in the illustrated embodiment the duration of the wash cycle of the warewasher is automatically controlled to last for at least a time period t1 but no longer than a time period t2. The rinse cycle 92 is initiated after the wash cycle has been ended, typically after some or all of the wash water has been drained from the wash chamber 10.

It is anticipated the time periods t1 and t2 and the desired rinse water temperature Td would typically be set in memory at the time of warewasher manufacture or by a service technician, but it is also recognized that in certain applications these values could be adjustable and set by the end user through a user interface.

In one embodiment in which the heater is a 208–240V heater and the tank 58 holds approximately 3 gallons of water, the time period t1 and time period t2 are approximately 84 seconds and 144 seconds respectively. The desired rinse temperature may be approximately 180° F.

In one embodiment of the warewasher, the controller 76 is provided with three preset modes of operation. A particular mode of operation may be selected by the manufacturer or a service technician before installation. A different mode of operation may be selected later as needed. In an automatic mode the duration of the wash cycle may be automatically controlled as previously described. In a low rise mode the wash cycle may be ended after the time period t1 regardless of the exact temperature of the rinse water in the tank 58. Likewise, in a high rise mode the wash cycle may run the full duration of the time period t2 without regard to the exact temperature of the rinse water in the tank 58.

Water Level Detection

Figure 4:
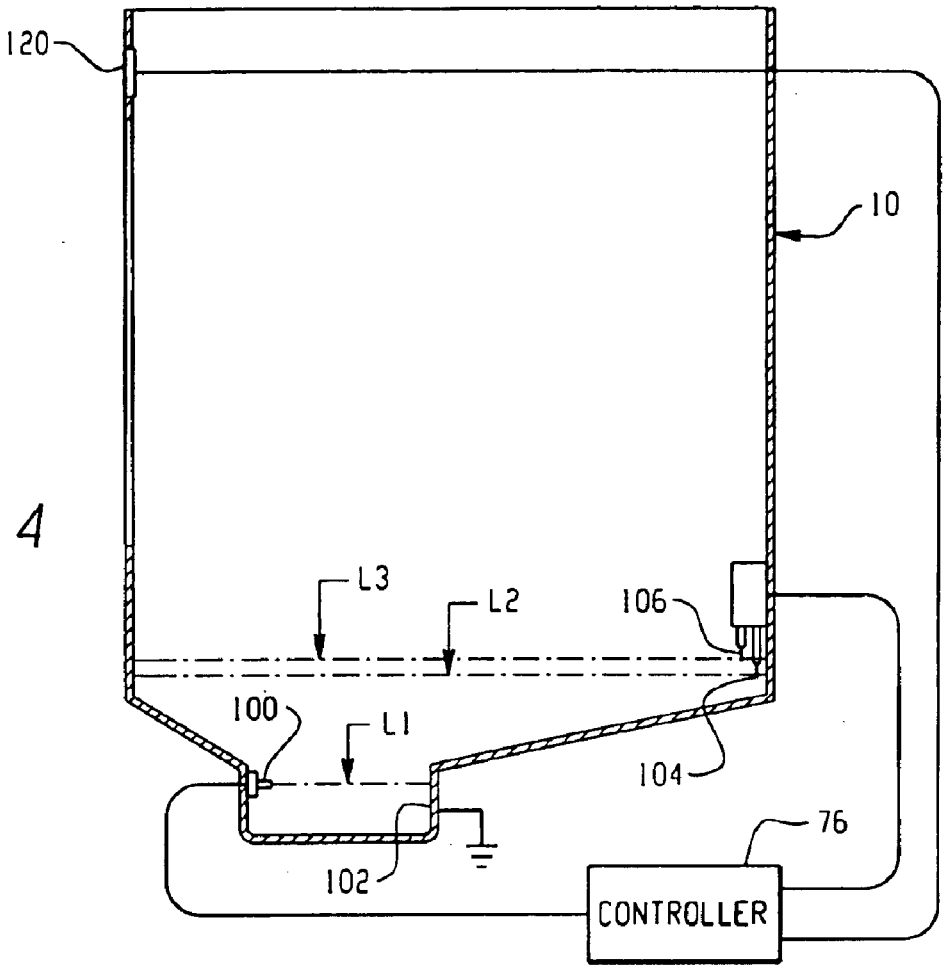
FIG. 4 is a side, internal view of a warewasher depicting water level probe location.

Referring primarily to FIG. 4, a water level detection system is now described. As previously noted, three water levels L1, L2, L3 may be detected in the illustrated embodiment. For level L1, a sensor system is provided by an electrode 100 spaced apart from a ground electrode 102, both electrodes within the wash chamber 10. In the illustrated embodiment the ground electrode 102 is formed by a part of the internal housing defining the wash chamber 10, such as a metallic part of the sump 22. For level L2, a sensor system is provided by electrode 104 spaced apart from ground electrode 102, and for level L3 a sensor system is provided by electrode 106 spaced apart from ground electrode 102. Thus, a common ground electrode 102 is provided for the sensor system of each level L1, L2 and L3. It is recognized, however, that separate ground electrodes could be provided for each level. The level detection technique used for each level may be the same. Accordingly, the following description is made with respect to level L3, but is understood to apply equally to levels L1 and L2.

Figure 5:
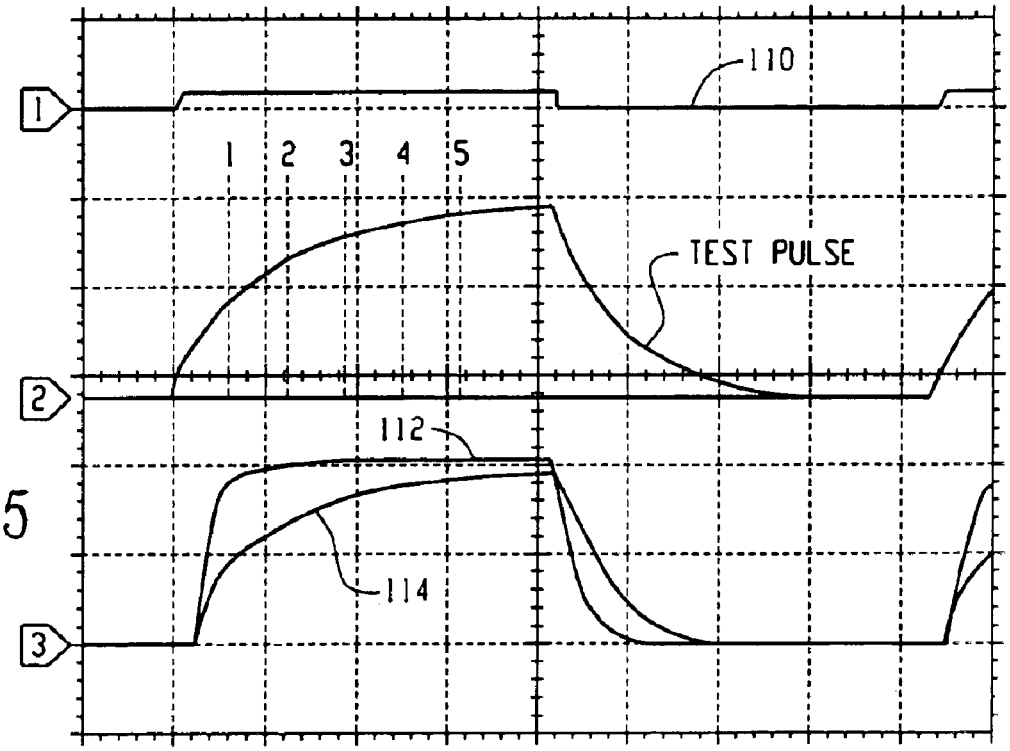
FIG. 5 is a graph of electrode response to a voltage pulse for multiple circumstances.

Referring to FIG. 5, in order to determine whether a volume of water within the chamber 10 is in contact with both the electrode 106 and the electrode 102, the controller 76 delivers a voltage pulse (e.g., a 5 volt square wave pulse) to the electrode 106. The controller 76 samples the voltage at the electrode 106 a plurality of times during application of the voltage pulse. In the illustrated example five sample voltages are taken but the number could vary. The controller 76 adds the plurality of voltage samples to produce a sample voltage sum, and then analyzes the sample voltage sum to determine whether the volume of liquid within the chamber 10 contacts both electrode 106 and electrode 102.

FIG. 5 shows three exemplary waveforms 110, 112 and 114 for a Clean & Wet electrode 106, a Dry electrode 106 and a Limed & Wet electrode 106 respectively. As shown, if the electrode 106 is clean and wet, meaning the water level is at or above the electrode 106, the electrode is substantially shorted to the ground electrode 102 through the liquid within the chamber 10. Therefore, the build up of voltage at the electrode 106 during application of the 5 volt pulse only reaches about 0.5 volts, due the relatively low resistance path provided by the liquid in the chamber 10. If the electrode 106 is dry, meaning the water level is below the electrode 106, no path to ground is provided and therefore the voltage at the electrode 106 is pulled high substantially immediately by application of the 5 volt pulse. If the electrode 106 is limed and wet, even though a path to ground is provided through the liquid, the resistance of the path is sufficiently large, due to the lime build up on the electrode 106, that the voltage at the electrode 106 builds up to close to the 5 volt value, but less quickly than in the case of the dry electrode.

Given the foregoing, the sample voltage sum can be used to (i) determine if the electrode 106 is submerged, (ii) determine if the electrode 106 is shorted to ground through a metallic article in the chamber (e.g., a spoon), (iii) determine if the electrode 106 is not submerged and (iv) determine if the electrode 106 is becoming limed over a period of time. The following table represents the determination of the sample voltage sum for each of these cases.

TABLE I

Exemplary Sample Voltage Sum (SVSum) Calculations

| Electrode Condition | Sample 1 | Sample 2 | Sample 3 | Sample 4 | Sample 5 | SVSum |
|---|---|---|---|---|---|---|
| Wet & Clean | 0.5 V | 0.5 V | 0.5 V | 0.5 V | 0.5 V | 2.5 V |
| Metal Shorted & Clean | 0.05 V | 0.05 V | 0.05 V | 0.05 V | 0.05 V | 0.25 V |
| Dry | 4.1 V | 5.0 V | 5.0 V | 5.0 V | 5.0 V | 24.1 V |
| Limed & Wet | 2.5 V | 4.0 V | 4.5 V | 4.9 V | 5.0 V | 20.9 V |

Given these exemplary sample values and sample voltage sums (SVSum), a clear distinction is seen between the sample voltage sum for a metal shorted electrode 106 and an electrode shorted through liquid. Accordingly, a shorted electrode threshold sum can be set at approximately 0.5 V. The sample voltage sum for any test pulse and sample sequence can be compared to this shorted threshold sum and if the sample voltage sum is less than the shorted threshold sum the controller 76 can output a shorted electrode indication signal (e.g., to a light or display 120 on the front of the warewasher) to notify the user to eliminate the short by clearing the metal article from the chamber 10.

Similarly, a wet threshold sum can be set at around 10.0 volts. For a given test pulse and sample sequence the controller 76 makes a determination that both electrodes 106 and 102 are contact with the water in chamber 10 only if the sample voltage sum does not exceed the wet threshold sum. Where the shorted threshold sum is provided as noted above, such a wet electrode 106 determination would be made when the sample voltage sum is between the shorted threshold sum and the wet threshold sum. If the shorted threshold sum is not provided (e.g., there is no provision for identifying when electrode 106 is shorted by a metallic object) then the wet electrode 106 determination could be made for all sample voltage sums below the wet threshold sum.

For the above example, a dry threshold sum can be set at around 20.0 volts. The controller 76 makes a determination that the volume of liquid within the chamber 10 is not high enough to contact both the electrode 106 and the electrode 102 if the sample voltage sum is greater than the dry threshold sum. Notably, the limed & wet sample voltage sum is also greater than 20.0, which could create an incorrect determination. However, the controller 76 can be configured to prevent such an occurrence as follows.

In particular, the controller 76 is operable to monitor, over time, for a change in sample voltage sum produced in cases where the determination is made that the volume of liquid within the chamber 10 contacts both the electrode 106 and electrode 102. For example, the controller 76 may create a log of such occurrences. The controller 76 initiates a fouling electrode indication signal (e.g., to the light or display 120 or to a service log in memory) if the change in sample voltage sum represents an increase of at least a certain amount or to at least certain level. The certain amount may be relative to previous measurements. For example, the fouling electrode indication signal could be generated when the clean and wet sample voltage sums increase over time by at least 5 volts. Alternatively, the fouling electrode indication signal could always be generated when the clean and wet sample voltage sums reaches a certain level, such as a level just below the wet threshold sum (e.g., around 9.0 volts in the above example).

Chemical Sensing And Priming

Figure 6:
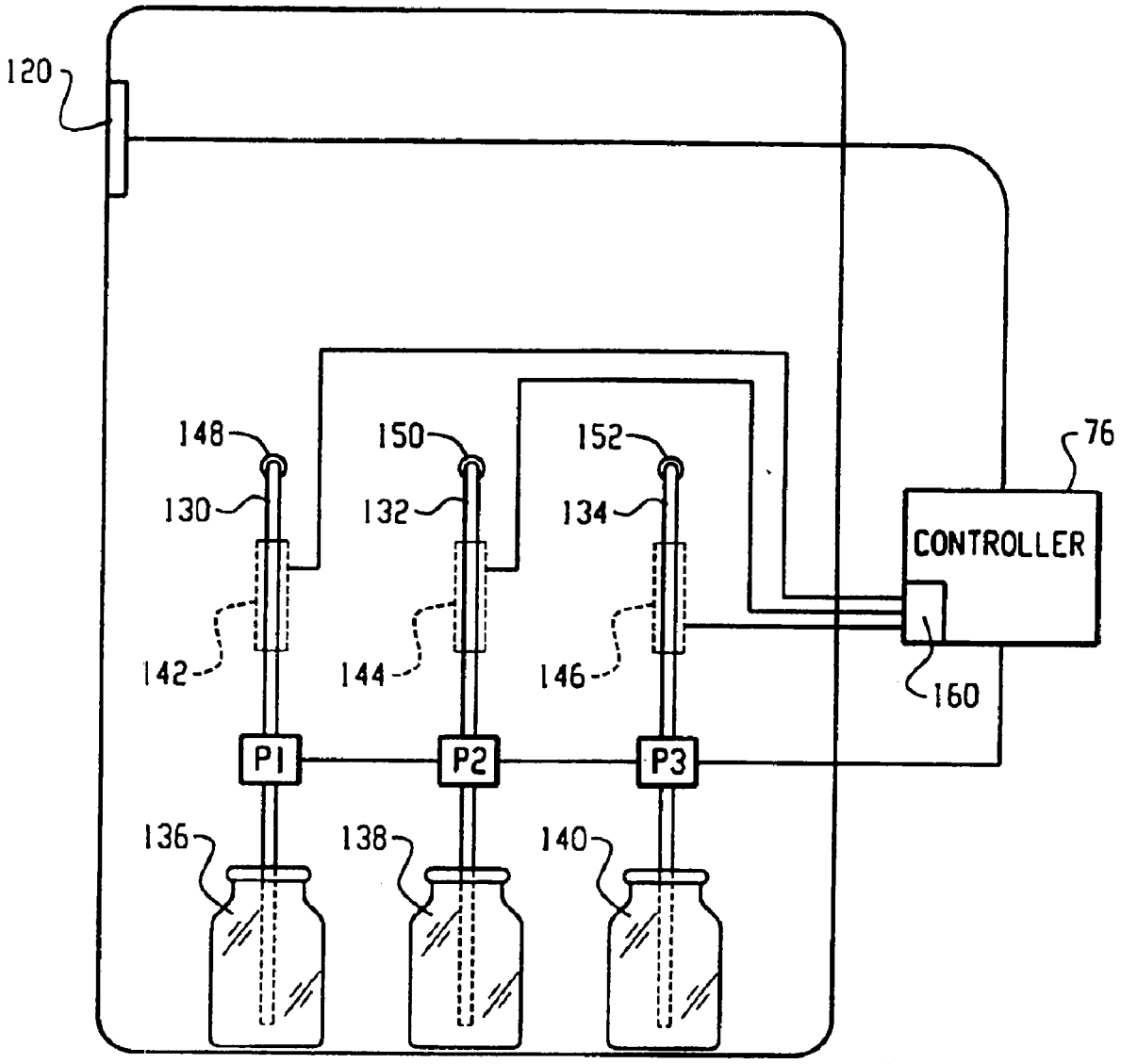
FIG. 6 is a side view of a warewasher showing a chemical feed system.

As previously mentioned, chemicals such as detergents, sanitizers and rinse agents may be delivered to the wash chamber 10 during various stages of warewasher operation. Referring to FIG. 6, the illustrated embodiment includes three chemical feed input lines 130, 132 and 134 that extend from respective chemical supply bottles 136, 138 and 140, which may hold detergent, sanitizer and rinse agent respectively. The bottles may, for example, be positioned alongside the warewasher. Positioned along each chemical feed line is a respective sensor 142, 144 and 146 for detecting the presence/absence of chemicals in the line. Each line extends into the warewasher chamber via a respective port 148, 150 and 152. Based upon the output from a given sensor, the controller 76 determines whether there is a need for the chemical associated with that sensor to be re-supplied and, if so, can produce a chemical refill indication signal on a display or other user interface 120. An exemplary description is provided below for feed line 130 and is understood to be common to all feed lines.

When the controller 76 determines that a chemical is absent from the chemical feed input line 130, as indicated by the sensor 142, in preparation for a washing operation the controller 76 automatically (e.g., without requiring user interaction) operates the pump P1 associated with the chemical feed line 130 in attempt to automatically prime the chemical feed line 130. During the priming operation of pump P1, when the controller 76 determines that the chemical is present, as indicated by the chemical sensor 142, the controller 76 continues the operation of the pump P1 for an additional set time period sufficient to assure that the chemical is fed along substantially the entire feed line and to the port 148. This additional set time period can be predetermined on a case by case basis and stored in memory of the controller 76. Alternatively, if the priming operation of pump P1 continues for a set maximum time period, which may also be stored in memory of the controller 76, then the priming operation of pump P1 is stopped and the controller 76 automatically initiates a chemical out indication signal to display 120, and the controller 76 may proceed with the washing operation. The set maximum time period can also be determined on a case by case basis according to various parameters such as pump size, feed line length and warewasher configuration.

In one embodiment each chemical sensor 142, 144 and 146 may be of the type described in U.S. Pat. No. 5,378,993, which is hereby incorporated by reference. The subject patent describes capacitive type sensing arrangement for sensing liquids in a chemical feed tube by using a wire wound resistor disposed around the tube and that acts as a capacitor in a filter circuit that filters the output of an oscillating circuit. In such cases, the portion 160 of controller 76 would includes the other circuit components described in U.S. Pat. No. 5,378,993. Of course, other sensor arrangements, including non-capacitive sensor arrangements could also be used in connection with the previously described automatic priming operation.

It is to be clearly understood that the above description is intended by way of illustration and example only and is not intended to be taken by way of limitation. Other changes and modifications could be made, including both narrowing and broadening variations and modifications of the appended claims.

What is claimed is:

1. A warewasher system, comprising:

a wash area for receiving objects to be washed;

means for delivering wash liquid to wares in the wash area during a wash cycle;

a tank and associated heater for heating rinse water;

a path for delivering water from the tank to the wash area;

a flow control device for controlling water flow along the path;

a temperature sensor for indicating a temperature of rinse water in the tank; and a controller connected to receive input from the temperature sensor, connected to control the flow control device and the means for delivering wash liquid, and having at least one operating mode that, if active, will carry out the following steps for the wash cycle:

heat rinse water during the wash cycle; and after the wash cycle runs for a set minimum duration:

end the wash cycle if the temperature of the rinse water has reached a desired rinse water temperature;

continue the wash cycle if the temperature of the rinse water has not reached the desired rinse water temperature and subsequently to:

(i) end the wash cycle if the temperature of the rinse water reaches the desired rinse water temperature;

(ii) end the wash cycle after a set maximum duration for the wash cycle even if the temperature of the rinse water has not reached the desired rinse water temperature.

2. A warewasher system, comprising:

a wash chamber for receiving objects to be washed;

a pump for recirculating wash water through the wash chamber during a wash cycle;

a tank and associated heater for heating rinse water;

a path for delivering water from the tank to the wash chamber;

a flow control device for controlling water flow along the path;

a temperature sensor for indicating a temperature of the rinse water in the tank; and a controller connected to receive input from the temperature sensor, connected to control the flow control device and the pump and having at least one operating mode that, if active, will carry out the following steps for a wash cycle:

heat rinse water during the wash cycle; and after the wash cycle runs for a set minimum duration:

end the wash cycle if the temperature of the rinse water has reached a desired rinse water temperature;

continue the wash cycle if the temperature of the rinse water has not reached the desired rinse water temperature and subsequently to:

(i) end the wash cycle if the temperature of the rinse water reaches the desired rinse water temperature;

(ii) end the wash cycle after a set maximum duration for the wash cycle even if the temperature of the rinse water has not reached the desired rinse water temperature.

3. The system of claim 2 wherein the set minimum duration, set maximum duration and desired rinse water temperature are stored in memory of the controller.

4. The system of claim 2 wherein the flow control device comprises a valve associated with an inlet of the tank and the path comprises an overflow path from the tank.

* * * * *